US012049901B2

(12) United States Patent
Yamasaki et al.

(10) Patent No.: US 12,049,901 B2
(45) Date of Patent: Jul. 30, 2024

(54) SERIAL AXIAL FAN

(71) Applicant: Nidec Corporation, Kyoto (JP)

(72) Inventors: Yuta Yamasaki, Kyoto (JP); Hideki Aoi, Kyoto (JP)

(73) Assignee: NIDEC CORPORATION, Kyoto (JP)

( * ) Notice: Subject to any disclaimer, the term of this patent is extended or adjusted under 35 U.S.C. 154(b) by 8 days.

(21) Appl. No.: 17/546,140

(22) Filed: Dec. 9, 2021

(65) Prior Publication Data

US 2022/0196021 A1 Jun. 23, 2022

(30) Foreign Application Priority Data

Dec. 18, 2020 (JP) ..... 2020-210024

(51) Int. Cl.
*F04D 19/00* (2006.01)
*F04D 29/54* (2006.01)

(52) U.S. Cl.
CPC ..... *F04D 19/007* (2013.01); *F04D 29/542* (2013.01)

(58) Field of Classification Search
CPC .... F04D 19/007; F04D 29/542; F04D 29/544; F04D 25/166; F04D 19/002; F04D 25/08
See application file for complete search history.

(56) References Cited

U.S. PATENT DOCUMENTS 5,470,200 A * 11/1995 Tupov ..... F04D 29/661 415/194
2007/0048123 A1* 3/2007 Chang ..... F04D 29/703 415/119
2008/0138201 A1 6/2008 Lin et al.
2008/0260517 A1* 10/2008 Hayashigaito ..... F04D 25/0613 417/423.1
2009/0226299 A1* 9/2009 Jin ..... F04D 29/544 417/247
2019/0085851 A1* 3/2019 Hakozaki ..... F04D 19/007

FOREIGN PATENT DOCUMENTS

WO WO-2010081294 A1 * 7/2010 ..... F04D 25/0613

* cited by examiner

*Primary Examiner* — Woody A Lee, Jr.
*Assistant Examiner* — Eric A Lange
(74) *Attorney, Agent, or Firm* — Keating & Bennett, LLP

(57) ABSTRACT

A serial axial fan includes a first axial fan, a second axial fan, and a rectifying portion. The second axial fan is on one side in the axial direction with respect to the first axial fan and is connected in series to the first axial fan with the rectifying portion interposed therebetween. The rectifying portion includes a chassis with a cylindrical shape surrounding the central axis, a rectifying blade portion extending to a radially inner side from a radially inner surface of the chassis, and an air feeding space on the radially inner side of the rectifying blade portion. The rectifying blade portion extends at least in the axial direction and is inclined relative to another side in the circumferential direction from another side in the axial direction toward the one side in the axial direction.

15 Claims, 6 Drawing Sheets

SERIAL AXIAL FAN

CROSS-REFERENCE TO RELATED APPLICATIONS

The present application claims priority under 35 U.S.C. § 119 to Japanese Patent Application No. 2020-210024, filed on Dec. 18, 2020, the entire contents of which are hereby incorporated herein by reference.

1. FIELD OF THE INVENTION

The present disclosure relates to a serial axial fan.

2. BACKGROUND

Conventionally, a serial axial fan is known in which a PQ characteristic is improved by connecting two axial fans in an axial direction. An airflow rectifying device having a plurality of rectifying blade pieces is connected between the two fans. When the upstream fan rotates, an airflow flows from the blades of the upstream fan to a stator blade and then to the rectifying blade pieces.

However, the PQ characteristic of the serial axial fan in which the rectifying blade piece is used in a rectifying device may become a characteristic of rising rightward in the intermediate area due to surging. In such an area, both a pressure difference and an air volume decrease due to surging, and thus there is a possibility that the air volume does not stabilize and greatly changes due to the pressure difference.

SUMMARY

An example embodiment of a serial axial fan of the present disclosure includes a first axial fan including a first impeller, a second axial fan including a second impeller, and a rectifying portion. The first impeller includes a first rotor blade. The first rotor blade is rotatable to one side in a circumferential direction about a central axis extending in an axial direction. The second impeller includes a second rotor blade. The second rotor blade is rotatable about the central axis. The second axial fan is on one side in the axial direction with respect to the first axial fan and is connected in series to the first axial fan with the rectifying portion interposed therebetween. The rectifying portion includes a chassis, a rectifying blade portion, and an air feeding space, and has a cylindrical shape surrounding the chassis and the central axis. The rectifying blade portion extends to a radially inner side from a radially inner surface of the chassis. The air feeding space is on the radially inner side of the rectifying blade portion. The rectifying blade portion extends at least in the axial direction and is inclined relative to another side in the circumferential direction from another side in the axial direction toward the one side in the axial direction. The air feeding space is an integral space through which an airflow is flowable on the radially inner side of the rectifying blade portion.

The above and other elements, features, steps, characteristics and advantages of the present disclosure will become more apparent from the following detailed description of the example embodiments with reference to the attached drawings.

DETAILED DESCRIPTION

Figure 1:
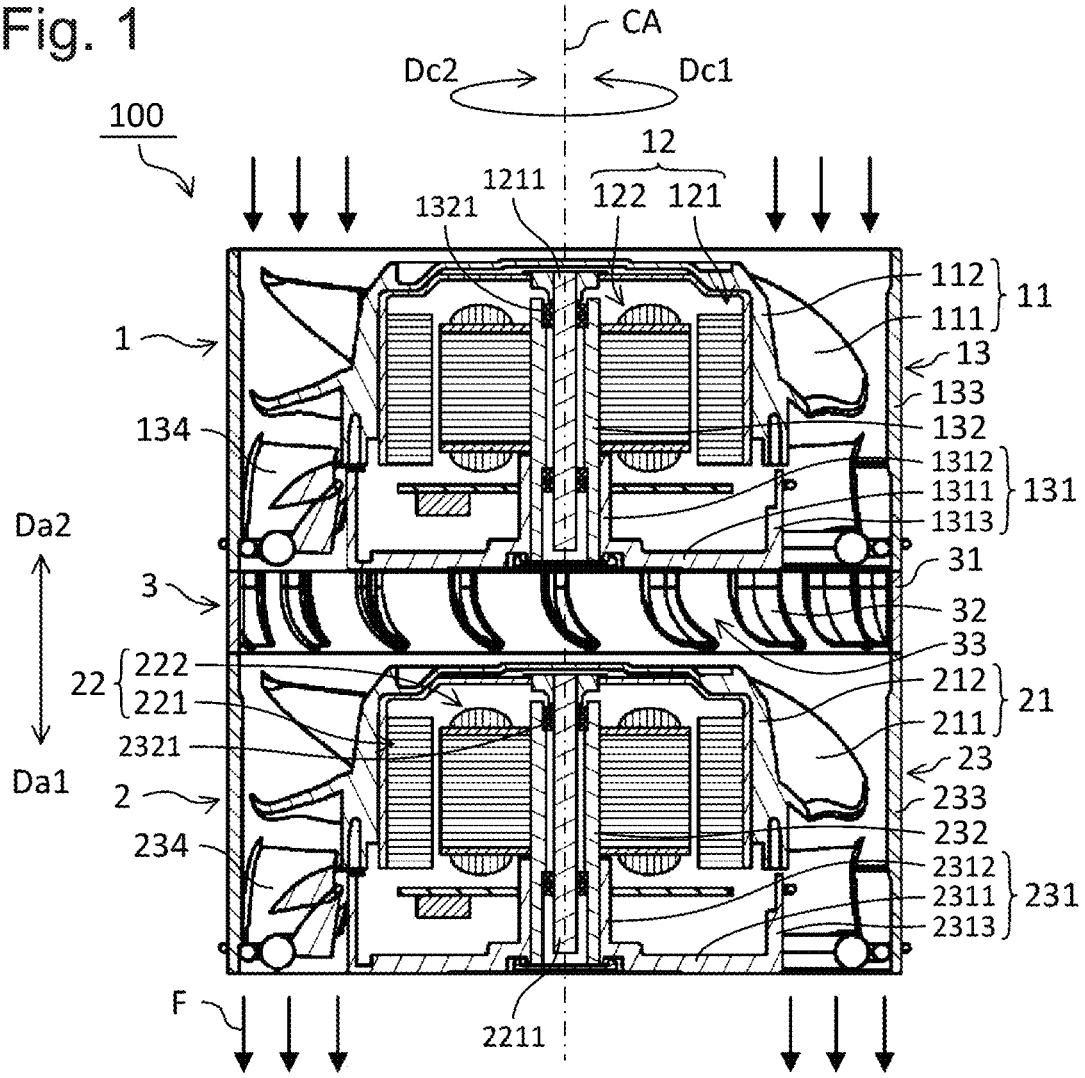
FIG. 1 is a cross-sectional view illustrating a configuration example of a serial axial fan according to an example embodiment of the present disclosure.

Hereinafter, example embodiments will be described with reference to the drawings.

Incidentally, in this specification, a direction parallel to a central axis CA in the serial axial fan 100 is referred to as an "axial direction". In the axial directions, a direction from a first axial fan 1 to a second axial fan 2 (to be described later) is referred to as "one side Da1 in the axial direction", and a direction from the second axial fan 2 to the first axial fan 1 is referred to as "the other side Da2 in the axial direction". In each component, an end portion on one side Da1 in the axial direction is referred to as "one axial end portion", and an end portion in the other side Da2 in the axial direction is referred to as "the other axial end portion". Further, in the surface of each component, a surface facing the one side Da1 in the axial direction is referred to as "one axial end face", and a surface facing the other side Da2 in the axial direction is referred to as "the other axial end face".

A direction perpendicular to the central axis CA is referred to as a "radial direction". In the radial direction, a direction toward the central axis CA is referred to as a "radially inner side", and a direction away from the central axis CA is referred to as a "radially outer side". In each component, an end portion on the radially inner side is referred to as a "radially inner end portion", and an end portion on the radially outer side is referred to as a "radially outer end portion". Further, in side surfaces of each component, a side surface facing the radially inner side is referred to as a "radially inner surface", and a side surface facing the radially outer side is referred to as a "radially outer surface".

A rotation direction about the central axis CA is referred to as a "circumferential direction". In each component, an end portion in the circumferential direction is referred to as a "circumferential end portion". In addition, an end portion on one side Dc1 in the circumferential direction is referred to as "one circumferential end portion", and an end portion on the other side Dc2 in the circumferential direction is referred to as "the other circumferential end portion". Further, in the side surfaces of each component, a side surface directed in the circumferential direction is referred to as a "circumferential side surface". Further, the side surface facing the one side Dc1 in the circumferential direction is referred to as "one circumferential side surface", and the side surface facing the other side Dc2 in the circumferential direction is referred to as "the other circumferential side surface".

In this specification, an "annular shape" includes not only a shape continuously connected without any cut along the entire circumference in the circumferential direction around the central axis CA but also a shape having one or more cuts in a part of the entire circumference around the central axis CA. Further, the "annular shape" also includes a shape having a closed curve around the central axis CA on a curved surface that intersects with the central axis CA.

In a positional relationship between any one and another of azimuths, lines, and surfaces, "parallel" includes not only a state where the two endlessly extend without intersecting at all but also a state where the two are substantially parallel. Further, "orthogonal" and "perpendicular" include not only a state where the two intersect each other at 90 degrees, but also a state where the two are substantially orthogonal and a state where the two are substantially perpendicular. That is, each of "parallel", "orthogonal", and "perpendicular" includes a state where the positional relationship between the two permits an angular deviation to a degree not departing from the gist of the present disclosure.

Note that, these terms are names used merely for description, and are not intended to limit actual positional relationships, directions, names, and the like.

Figure 2:
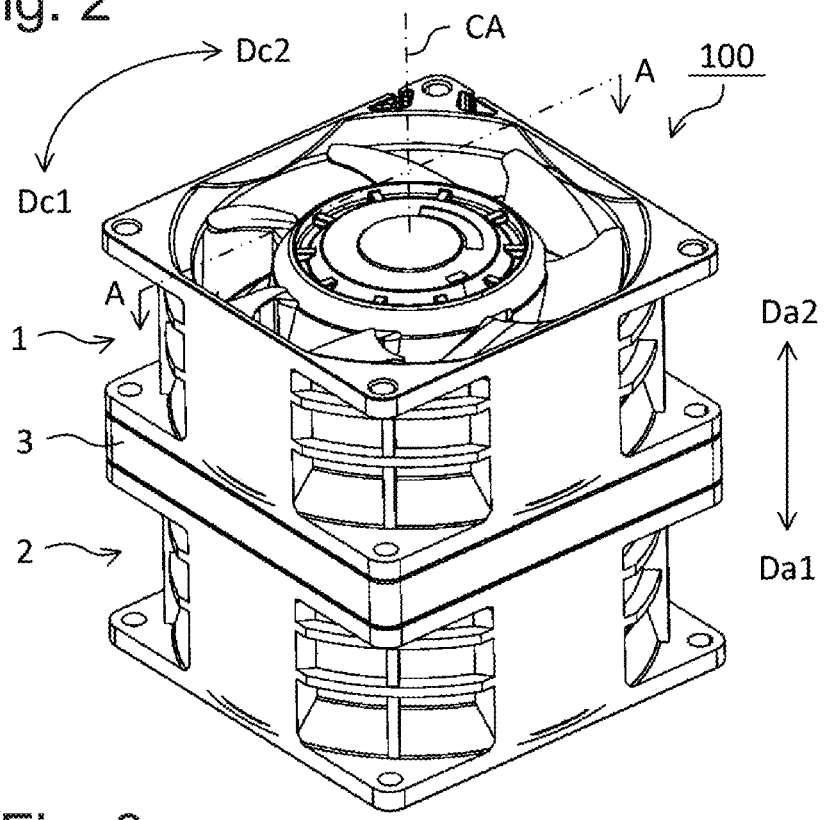
FIG. 2 is a perspective view of a serial axial fan according to an example embodiment of the present disclosure.

FIG. 1 is a cross-sectional view illustrating a configuration example of the serial axial fan 100 according to the example embodiment. FIG. 2 is a perspective view of the serial axial fan 100. Incidentally, FIG. 1 illustrates a cross-sectional structure of the serial axial fan 100 taken along a virtual plane which includes a two-dot chain line A-A in FIG. 2 and is orthogonal to the axial direction.

As illustrated in FIG. 1, the serial axial fan 100 includes a first axial fan 1 having a first impeller 11, a second axial fan 2 having a second impeller 21, and a rectifying portion 3. The serial axial fan 100 is a blower apparatus in which a first axial fan 1 at a preceding stage and a second axial fan 2 at a subsequent stage are connected in series with the rectifying portion 3 interposed therebetween. The serial axial fan 100 takes in an airflow F through an opening of the other axial end portion of the first axial fan 1, and sends out the airflow F through an opening of one axial end portion of the second axial fan 2. The second axial fan 2 is disposed on the one side Da1 in the axial direction with respect to the first axial fan 1, and is connected in series with the first axial fan 1 with the rectifying portion 3 interposed therebetween.

The rectifying portion 3 rectifies the airflow F sent from the first axial fan 1 to the one side Da1 in the axial direction. The second axial fan 2 sucks the airflow F rectified by the rectifying portion 3. The rectified airflow F has a small swirl component and easily flows in the axial direction by the second axial fan 2. Accordingly, the pressure and the air volume of the airflow F sent from the second axial fan 2 increase. As a result, the amount of air sucked or sent by the serial axial fan 100 can be increased. Therefore, the blowing efficiency of the serial axial fan 100 can further be improved.

Next, a configuration of the first axial fan 1 will be described with reference to FIGS. 1 and 2.

As described above, the first axial fan 1 includes the first impeller 11. The first impeller 11 is attached to the first rotor 121 (to be described later) of the first motor unit 12. For example, the first impeller 11 includes a first impeller base 112 having a covered cylindrical shape. The first impeller base 112 covers the other axial end portion and the radially outer surface of the first rotor 121. Further, the first impeller 11 further includes a first rotor blade 111. The first rotor blade 111 is rotatable to the one side Dc1 in the circumferential direction about the central axis CA extending in the axial direction. That is, when the first axial fan 1 is driven, the first impeller 11 rotates to the one side Dc1 in the circumferential direction.

In this example embodiment, the first rotor blade 111 extends to the radially outer side from the radially outer surface of the first impeller base 112. Incidentally, the present disclosure is not limited to this example. The first impeller 11 may not include the first impeller base 112, and the first rotor blade 111 may be disposed on the radially outer surface of the first rotor 121.

In the axial direction, the first rotor blade 111 extends to the front side (that is, the one side Dc1 in the circumferential direction) in the rotational direction toward the other side Da2 in the axial direction. Further, in at least the portion of the first rotor blade 111 on the other side Da2 in the axial direction, the radially outer end portion of the first rotor blade 111 extends the radially inner side toward the other side Da2 in the axial direction. That is, when viewed in the axial direction, the portion of the first rotor blade 111 closest to the other side Da2 in the axial direction is located on the radially inner side with respect to the radially outermost portion of the first rotor blade 111.

The first axial fan 1 further includes the first motor unit 12 and a first housing 13.

The first motor unit 12 includes a first shaft 1211, a first rotor 121, and a first stator 122. The first shaft 1211 extends in the axial direction along the central axis CA. The first rotor 121 is attached to the other axial end portion of the first shaft 1211. The first rotor 121 is rotatable about the central axis CA together with the first shaft 1211. The first stator 122 opposes the first rotor 121 in the radial direction, and rotates the first rotor 121 according to energization.

When the first motor unit 12 rotates the first impeller 11 together with the first rotor 121, the first rotor blade 111 rotates about the central axis CA. Accordingly, the first axial fan 1 sucks air on the other side Da2 in the axial direction of the serial axial fan 100 at the other axial end portion of the first axial fan 1. Further, the first axial fan 1 generates the airflow F flowing to the one side Da1 in the axial direction, and sends out the airflow F from one axial end portion of the first axial fan 1.

Next, the first housing 13 includes a first bracket portion 131, a first bearing holder 132, a first housing cylindrical portion 133, and a first stator blade 134.

The first bracket portion 131 is disposed at one axial end portion of the first axial fan 1. The first bracket portion 131 includes a first bottom lid portion 1311, a first bearing holder holding portion 1312, and a first outer wall portion 1313. The first bottom lid portion 1311 has an annular shape surrounding the central axis CA and extends in the radial direction. The first bearing holder holding portion 1312 is disposed at the radially inner end portion of the first bottom lid portion 1311. The first bearing holder holding portion 1312 has a cylindrical shape extending to the other side Da2 in the axial direction and holds the first bearing holder 132. The annular first outer wall portion 1313 protruding to the other side Da2 in the axial direction is provided at the radially outer end portion of the first bottom lid portion 1311. The other axial end portion of the first bottom lid portion 1311 axially opposes one axial end portion of the first rotor 121.

The first bearing holder 132 has a cylindrical shape extending in the axial direction, and is inserted and fixed inside the first bearing holder holding portion 1312. The first bearing holder 132 supports the first motor unit 12 and a substrate (reference numeral is omitted). For example, the first stator 122 is fixed to the radially outer surface of the first bearing holder 132. Further, the first bearing holder 132 rotatably supports the first shaft 1211 via a plurality of first bearings 1321. For example, the outer rings of the plurality of first bearings 1321 are fixed to the radially inner surface of the first bearing holder 132. The inner rings of the plurality of first bearings 1321 are fixed to the radially outer surface of the first shaft 1211.

The first housing cylindrical portion 133 has a cylindrical shape extending in the axial direction, and accommodates the first impeller 11 and the first motor unit 12 therein. Further, the first bracket portion 131 and the first bearing holder 132 are disposed on the radially inner side with respect to the first housing cylindrical portion 133. One axial end portion of the first housing cylindrical portion 133 is axially connected to the other axial end portion of the second housing cylindrical portion 233 via the rectifying portion 3.

The first stator blade 134 is disposed on the radially outer side with respect to the first bracket portion 131 and is disposed on the radially inner side with respect to the first housing cylindrical portion 133. The radially inner end portion of the first stator blade 134 is connected to the radially outer surface of the first outer wall portion 1313, and the radially outer end portion of the first stator blade 134 is connected to the radially inner surface of the first housing cylindrical portion 133. The first stator blade 134 is disposed on the one side Da1 in the axial direction with respect to the first rotor blade 111, and is disposed on the other side Da2 in the axial direction with respect to the rectifying blade portion 32 (to be described later) of the rectifying portion 3. The first axial fan 1 includes the first stator blade 134. In the axial direction, the first stator blade 134 extends at least in the axial direction, and extends to the front side (that is, the one side Dc1 in the circumferential direction) in the rotation direction of the first rotor blade 111 toward the one side Da1 in the axial direction. When viewed from the axial direction, the first stator blade 134 is inclined in a direction opposite to the first rotor blade 111. Accordingly, noise generation in the first axial fan 1 can be suppressed.

Next, a configuration of the second axial fan 2 will be described with reference to FIGS. 1 and 2.

As described above, the second axial fan 2 includes the second impeller 21. The second impeller 21 is attached to a second rotor 221 (to be described later) of the second motor unit 22. For example, the second impeller 21 includes a second impeller base 212 having a covered cylindrical shape. The second impeller base 212 covers the other axial end portion and the radially outer surface of the second rotor 221. Further, the second impeller 21 further includes a second rotor blade 211. The second rotor blade 211 is rotatable to the one side Dc1 in the circumferential direction about the central axis CA. That is, when the second axial fan 2 is driven, the second impeller 21 rotates to the one side Dc1 in the circumferential direction. By rotating the second impeller 21 in the same direction as that of the first impeller 11 in the circumferential direction, the serial axial fan 100 can function as a tandem fan. However, the present disclosure is not limited to this example, and the second impeller 21 may rotate to the other side Dc2 in the circumferential direction when the second axial fan 2 is driven. By rotating the second impeller 21 in a direction opposite to that of the first impeller 11 in the circumferential direction, the serial axial fan 100 can function as a reversing fan.

The second rotor blade 211 extends to the radially outer side from the radially outer surface of the second impeller base 212. Incidentally, the present disclosure is not limited to the example of this example embodiment. The second impeller 21 may not include the second impeller base 212, and the second rotor blade 211 may be disposed on the radially outer surface of the second rotor 221.

In the axial direction, the second rotor blade 211 extend to the front side (that is, the one side Dc1 in the circumferential direction) in the rotational direction toward the other side Da2 in the axial direction. Further, in at least the portion of the second rotor blade 211 on the other side Da2 in the axial direction, the radially outer end portion of the second rotor blade 211 extends the radially inner side toward the other side Da2 in the axial direction. That is, the portion of the second rotor blade 211 closest to the other side Da2 in the axial direction is located on the radially inner side with respect to the radially outermost portion of the second rotor blade 211 (see broken lines L1 and L2 in FIGS. 6 and 7 described later).

The second axial fan 2 further includes a second motor unit 22 and a second housing 23.

The second motor unit 22 includes a second shaft 2211, a second rotor 221, and a second stator 222. The second shaft 2211 extends in the axial direction along the central axis CA. The second rotor 221 is attached to the other axial end portion of the second shaft 2211. The second rotor 221 is rotatable about the central axis CA together with the second shaft 2211. The second stator 222 opposes the second rotor 221 in the radial direction, and rotates the second rotor 221 according to energization.

When the second motor unit 22 rotates the second impeller 21 together with the second rotor 221, the second rotor blade 211 rotates about the central axis CA. Accordingly, the second axial fan 2 sucks the airflow F in the rectifying portion 3 at the other axial end portion of the second axial fan 2. The second axial fan 2 generates the airflow F flowing to the one side Da1 in the axial direction, and sends out the airflow F from one axial end portion of the second axial fan 2.

Next, the second housing 23 includes a second bracket portion 231, a second bearing holder 232, a second housing cylindrical portion 233, and a second stator blade 234.

The second bracket portion 231 is disposed at one axial end portion of the second axial fan 2. The second bracket portion 231 includes a second bottom lid portion 2311, a second bearing holder holding portion 2312, and a second outer wall portion 2313. The second bottom lid portion 2311 has an annular shape surrounding the central axis CA and extends in the radial direction. The second bearing holder holding portion 2312 is disposed at the radially inner end portion of the second bottom lid portion 2311. The second bearing holder holding portion 2312 has a cylindrical shape extending to the other side Da2 in the axial direction and holds the second bearing holder 232. The annular second outer wall portion 2313 protruding to the other side Da2 in the axial direction is provided at the radially outer end portion of the second bottom lid portion 2311. The other axial end portion of the second bottom lid portion 2311 axially opposes one axial end portion of the second rotor 221.

The second bearing holder 232 has a cylindrical shape extending in the axial direction, and is inserted and fixed inside the second bearing holder holding portion 2312. The second bearing holder 232 supports the second motor unit 22 and a substrate (reference numeral is omitted). For example, the second stator 222 is fixed to the radially outer surface of the second bearing holder 232. Further, the second bearing holder 232 rotatably supports the second shaft 2211 via a plurality of second bearings 2321. For example, the outer rings of the plurality of second bearings 2321 are fixed to the radially inner surface of the second bearing holder 232. The inner rings of the plurality of second bearings 2321 are fixed to the radially outer surface of the second shaft 2211.

The second housing cylindrical portion 233 has a cylindrical shape extending in the axial direction, and accommodates the second impeller 21 and the second motor unit 22 therein. Further, the second bracket portion 231 and the second bearing holder 232 are disposed on the radially inner side with respect to the second housing cylindrical portion 233. One axial end portion of the second housing cylindrical portion 233 is axially connected to the other axial end portion of the second housing cylindrical portion 233 via the rectifying portion 3.

The second stator blade 234 is disposed on the radially outer side with respect to the second bracket portion 231 and is disposed on the radially inner side with respect to the second housing cylindrical portion 233. The radially inner end portion of the second stator blade 234 is connected to the radially outer surface of the second outer wall portion 2313, and the radially outer end portion of the second stator blade 234 is connected to the radially inner surface of the second housing cylindrical portion 233. The second stator blade 234 is disposed in the one side Da1 in the axial direction with respect to the second rotor blade 211. The second stator blade 234 extends at least in the axial direction, and extends to the front side (that is, the one side Dc1 in the circumferential direction) in the rotation direction of the second rotor blade 211 toward the one side Da1 in the axial direction. When viewed from the axial direction, the second stator blade 234 is inclined in a direction opposite to the second rotor blade 211. Accordingly, noise generation in the second axial fan 2 can be suppressed.

Figure 3:
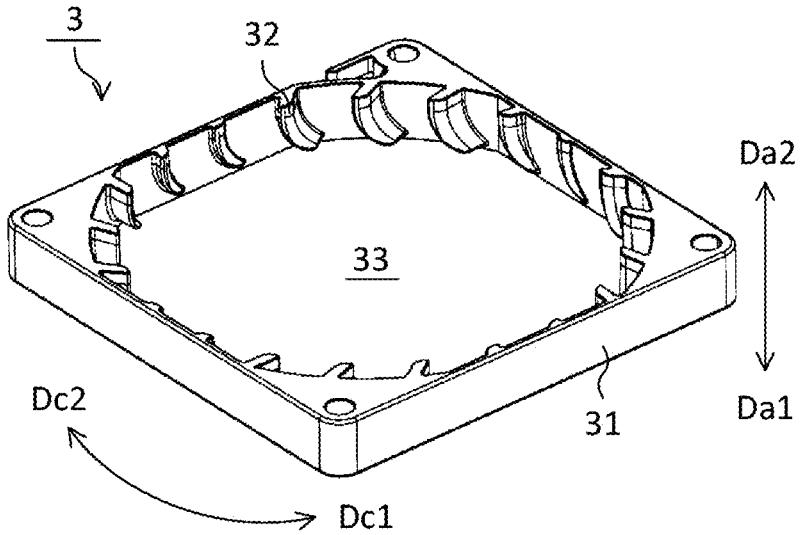
FIG. 3 is a perspective view illustrating a configuration example of a rectifying portion according to an example embodiment of the present disclosure.

Next, a configuration of the rectifying portion 3 will be described with reference to FIGS. 1 to 3. FIG. 3 is a perspective view illustrating a configuration example of the rectifying portion 3.

The rectifying portion 3 is disposed at a connection portion between the first housing 13 of the first axial fan 1 and the second housing 23 of the second axial fan 2. The material of the rectifying portion 3 is aluminum in this example embodiment, but is not limited to this example, and may be another metal material, a ceramic material, a resin material, or the like.

The rectifying portion 3 includes a chassis 31, the rectifying blade portion 32, and an air feeding space 33. The chassis 31 has a cylindrical shape surrounding the central axis CA. The rectifying blade portion 32 extends to the radially inner side from the radially inner surface of the chassis 31. The air feeding space 33 is provided on the radially inner side of the rectifying blade portion 32. The rectifying blade portion 32 extends at least in the axial direction and is inclined to the other side Dc2 in the circumferential direction from the other side Da2 in the axial direction toward the one side Da1 in the axial direction. The air feeding space 33 is an integral space through which the airflow F can flow on the radially inner side of the rectifying blade portion 32.

When the rectifying blade portion 32 is provided on the radially inner surface of the chassis 31 of the rectifying portion 3 disposed between the first axial fan 1 and the second axial fan 2, the PQ characteristic and the blowing efficiency of the serial axial fan 100 are improved as compared with a configuration in which the rectifying blade portion 32 is not provided. Further, the PQ characteristic of the serial axial fan 100 can be further improved by providing the air feeding space 33 on the radially inner side with respect to the rectifying blade portion 32.

The chassis 31 is disposed between a first housing 13 of the first axial fan 1 and a second housing 23 of the second axial fan 2. Another axial end portion of the chassis 31 is connected to one axial end portion of the first housing 13, and one axial end portion of the chassis 31 is connected to another axial end portion of the second housing 23. The chassis 31, the first housing 13, and the second housing 23 form a wind tunnel continuously connected in the axial direction.

In this example embodiment, the rectifying portion 3 is not a part of the first axial fan 1 and is not a part of the second axial fan 2. However, the present disclosure is not limited to this example, and the rectifying portion 3 is not a part of one of the first axial fan 1 and the second axial fan 2, but may be a part of the other fan. In other words, preferably, the rectifying portion 3 may be a member different from at least one of the first axial fan 1 and the second axial fan 2. In this way, the components of the serial axial fan 100 can be prevented from becoming complicated. Therefore, the degree of freedom in designing the serial axial fan 100 can be improved.

Figure 4:
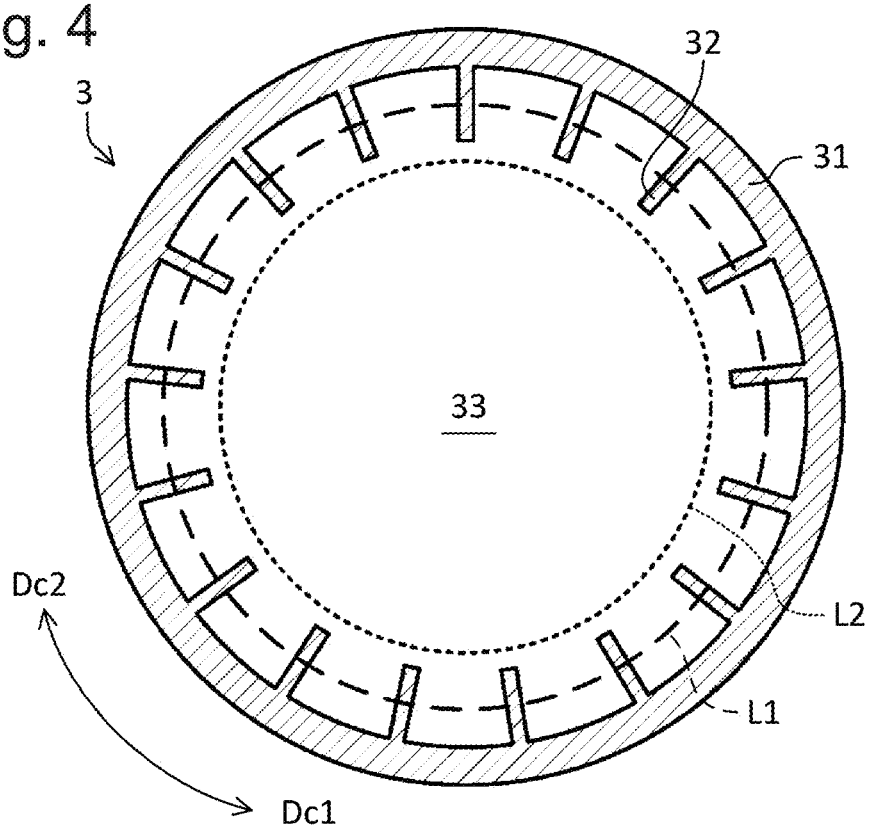
FIG. 4 is a conceptual diagram illustrating a configuration example of a rectifying portion according to an example embodiment of the present disclosure as viewed from an axial direction.
Figure 5:
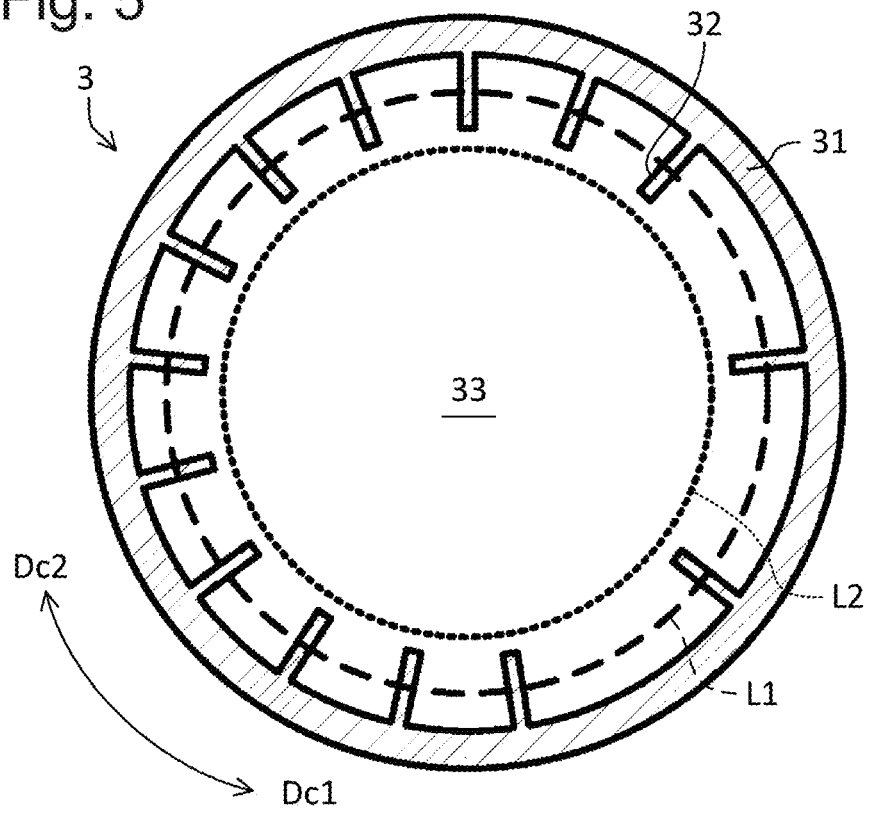
FIG. 5 is a conceptual diagram illustrating another configuration example of a rectifying portion according to an example embodiment of the present disclosure as viewed from the axial direction.
Figure 6:
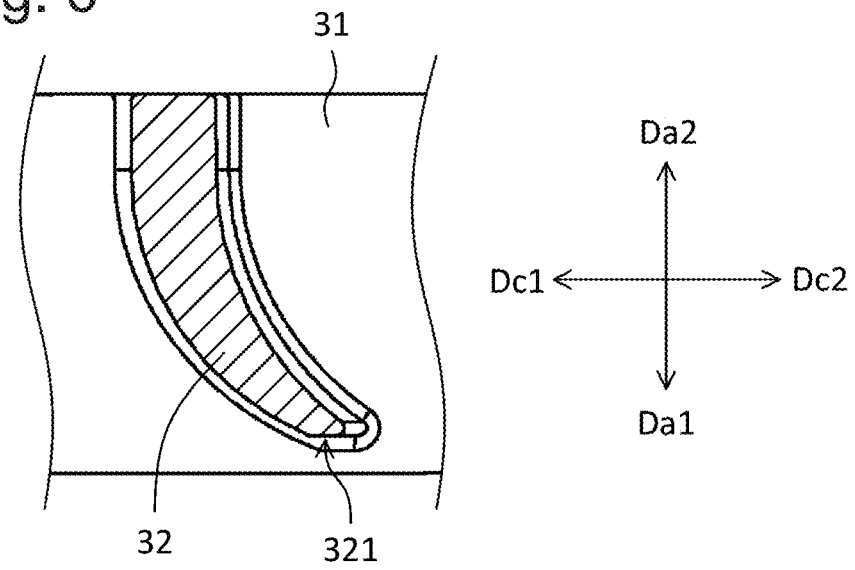
FIG. 6 is a cross-sectional view illustrating a configuration example of a rectifying blade portion according to an example embodiment of the present disclosure as viewed from a radial direction.
Figure 7:
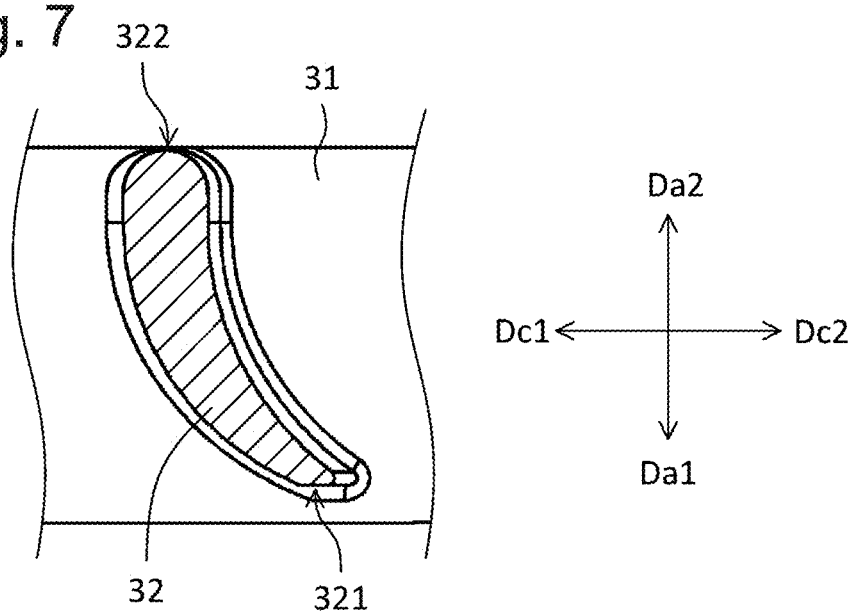
FIG. 7 is a cross-sectional view illustrating another configuration example of a rectifying blade portion according to an example embodiment of the present disclosure as viewed from the radial direction.

Next, details of the rectifying blade portion 32 will be described with reference to FIGS. 3 to 7. FIG. 4 is a conceptual diagram illustrating an arrangement example of the rectifying blade portion 32 as viewed from the axial direction. FIG. 5 is a conceptual diagram illustrating another arrangement example of the rectifying blade portion 32 as viewed from the axial direction. FIG. 6 is a cross-sectional view illustrating a configuration example of the rectifying blade portion 32 as viewed from the radial direction. FIG. 7 is a cross-sectional view illustrating another configuration example of the rectifying blade portion 32 as viewed from the radial direction. Incidentally, in FIGS. 4 and 5, a circular rough broken line L1 indicates a trajectory of the radially outermost portion of the second rotor blade 211 during the rotation of the second impeller 21 as viewed from the axial direction. A circular broken line L2 finer than the broken line L1 indicates a trajectory of a portion of the second rotor blade 211 closest to the other side Da2 in the axial direction during the rotation of the second impeller 21 as viewed from the axial direction. That is, the portion of the second rotor blade 211 closest to the other side Da2 in the axial direction is located on the radially inner side with respect to the radially outermost portion of the second rotor blade 211.

In FIGS. 4 and 5, the radially inner end portion of the rectifying blade portion 32 is located on the radially inner side with respect to the broken line L1, that is, disposed on the radially inner side with respect to the radially outermost portion of the second rotor blade 211. However, the present disclosure is not limited to this example, and the radially inner end portion of the rectifying blade portion 32 may be located at the same radial position as the radially outermost portion of the second rotor blade 211, or may be disposed on the radially outer side with respect to the radially outermost portion of the second rotor blade 211.

In FIGS. 4 and 5, the rectifying blade portion 32 is located on the radially outer side with respect to the broken line L2.

That is, the rectifying blade portion 32 is disposed on the radially outer side with respect to the portion of the second rotor blade 211 closest to the other side Da2 in the axial direction. In this way, the disturbance of the airflow F in the air feeding space 33 can be suppressed, and thus surging of the PQ characteristic is less likely to occur. Further, the PQ characteristic can be improved. Incidentally, surging is a phenomenon that both a pressure difference between an exhaust side and an intake side of the axial fan and the air volume decrease.

A plurality of rectifying blade portions 32 are arranged on the radially inner surface of the chassis 31 in the circumferential direction. In this example embodiment, as illustrated in FIG. 4, the plurality of rectifying blade portions 32 are arranged at equal intervals in the circumferential direction. In this way, the airflow F flowing toward at least the one side Da1 in the axial direction between the rectifying blade portions 32 can be rectified without bias in the circumferential direction. Therefore, the airflow F is less likely to be disturbed.

However, the arrangement of the rectifying blade portions 32 is not limited to the example of FIG. 4. For example, as illustrated in FIG. 5, at least some of the plurality of rectifying blade portions 32 arranged in the circumferential direction may be arranged at intervals different those of the other portions. In a case where the rectifying blade portions 32 are arranged at equal intervals, when noise is generated at the same timing in each rectifying blade portion 32, the noise may increase according to the number of rectifying blade portions 32 due to resonance. Therefore, the resonance of the noise can be suppressed when the timing at which the noise is generated is shifted by setting the intervals of at least some of the rectifying blade portions 32 arranged in the circumferential direction to be different from the intervals of the other portions.

Preferably, the number of rectifying blade portions 32 is equal to or larger than the number of first stator blades 134. By providing more rectifying blade portions 32, the rectifying effect of the airflow F in the rectifying portion 3 can be further enhanced. Incidentally, the rectifying blade portion 32 is provided on the radially inner surface of the chassis 31 having a cylindrical shape surrounding the central axis CA, and thus the rectifying blade portion is separated from the central axis CA. Therefore, it is easy to increase the number of the disposed rectifying blade portions 32. However, this example does not exclude a configuration in which the number of rectifying blade portions 32 is less than the number of first stator blades 134.

Preferably, the number of rectifying blade portions 32 is coprime to the number of the blade portions in at least one of the first rotor blade 111 and the second rotor blade 211. In a case where two or more rectifying blade portions 32 intersect in the circumferential direction at the same timing as that of the blade portions of the at least one, noise is generated at the same timing in two or more rectifying blade portions 32. The noise generated at the same timing may increase due to resonance. Therefore, by setting the number of blade portions of at least one of the first rotor blades 111 and the second rotor blades 211 to be coprime to the number of the rectifying blade portions 32 and shifting the timing at which noise is generated, the resonance of noise as described above can be suppressed. However, this configuration does not exclude a configuration in which the number of rectifying blade portions 32 is coprime to neither the number of first rotor blades 111 nor the number of second rotor blades 211.

Next, as described above, the rectifying blade portion 32 extends at least in the axial direction. In this example embodiment, the axial lengths of all the rectifying blade portions 32 are less than the axial length of the chassis 31 (see FIG. 1). For example, in the axial direction, the position of the other axial end portion of the rectifying blade portion 32 is the same as the position of the other axial end portion of the chassis 31. The one axial end portion of the rectifying blade portion 32 is located on the one side Da1 in the axial direction with respect to the one axial end portion of the chassis 31.

A portion of the rectifying blade portion 32 on the one side Da1 in the axial direction is inclined in the same direction as that of the first stator blade 134. For example, the first stator blade 134 extends at least in the axial direction and is inclined to the other side Dc2 in the circumferential direction from the other side Da2 in the axial direction toward the one side Da1 in the axial direction. Since the first stator blade 134 and the rectifying blade portion 32 are inclined in the same circumferential direction in the axial direction, the airflow F rectified by the first stator blade 134 flows along the rectifying blade portion 32 without being disturbed by hitting the rectifying blade portion 32. Then, the airflow F is accelerated in one side Da1 in the axial direction by the second impeller 21. Therefore, a higher PQ characteristic can be obtained.

As illustrated in FIG. 3 and the like, the rectifying blade portion 32 extends to the radially inner side from the radially inner surface of the chassis 31. The circumferential width of the rectifying blade portion 32 gradually decreases from the radially outer side toward the radially inner side. In this way, disturbance is less likely to occur in the airflow F flowing in the vicinity of the rectifying blade portion 32, which can contribute to improvement of the PQ characteristic.

As illustrated in FIGS. 6 and 7, the rectifying blade portion 32 has a first curved portion 321. The first curved portion 321 is disposed at one axial end portion of the rectifying blade portion 32. The first curved portion 321 has a curved surface protruding toward one side Da1 in the axial direction and the other side Dc2 in the circumferential direction in cross-sectional view as viewed from the radial direction. The tip portion of the rectifying blade portion 32 on the one side Da1 in the axial direction is rounded when viewed from the radial direction, so that the PQ characteristic can be improved. However, the examples of FIGS. 6 and 7 do not exclude a configuration in which the rectifying blade portion 32 does not have the first curved portion 321.

Preferably, as illustrated in FIG. 7, the rectifying blade portion 32 has a second curved portion 322. The second curved portion 322 is disposed at the other axial end portion of the rectifying blade portion 32. The second curved portion 322 has a curved surface protruding toward the other side Da2 in the axial direction in cross-sectional view as viewed from the radial direction. When the other axial end portion of the rectifying blade portion 32 is rounded when viewed from the radial direction, the PQ characteristic can be further improved.

Figure 8:
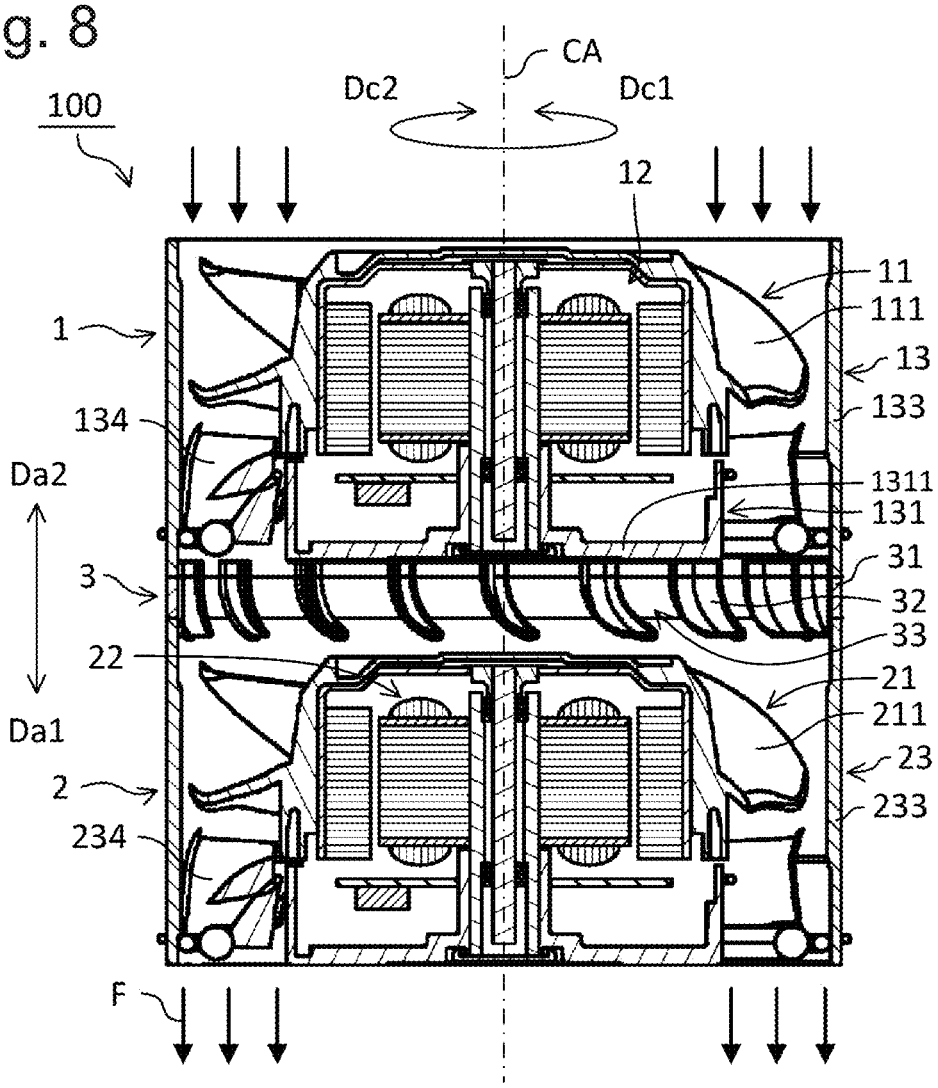
FIG. 8 is a cross-sectional view illustrating a configuration example of a serial axial fan according to a first modification of an example embodiment of the present disclosure.
Figure 9:
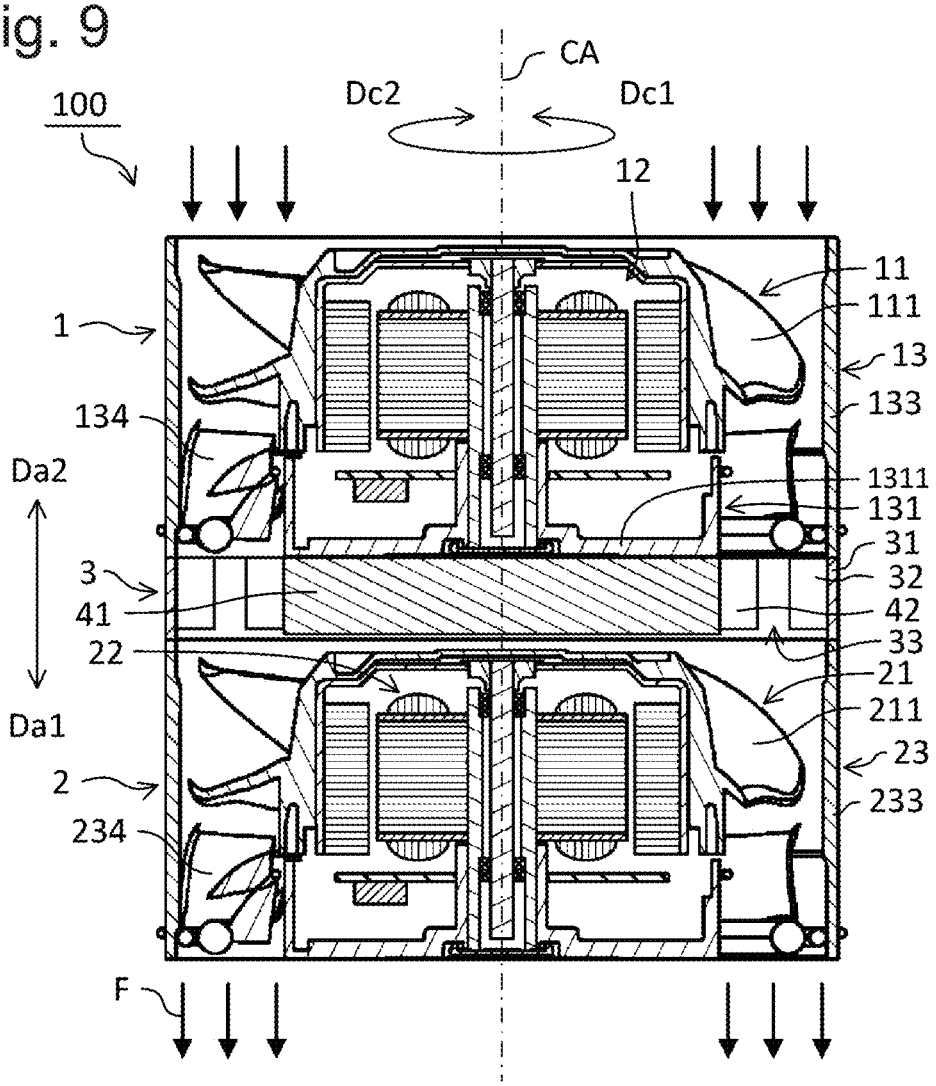
FIG. 9 is a cross-sectional view illustrating a configuration example of a serial axial fan according to a second modification of an example embodiment of the present disclosure.

Next, a first modification and a second modification of the example embodiment will be described with reference to FIGS. 8 and 9. FIG. 8 is a cross-sectional view illustrating a configuration example of the serial axial fan 100 according to the first modification of the example embodiment. FIG. 9 is a cross-sectional view illustrating a configuration example of the serial axial fan 100 according to the modification of the example embodiment. Incidentally, FIGS. 8 and 9 each correspond to a cross-sectional structure of the serial axial fan 100 taken along a virtual plane which includes the two-dot chain line A-A in FIG. 2 and is orthogonal to the axial direction. Further, a configuration different from that of the above-described example embodiment will be described below. Further, the same components as those in the above-described example embodiment are designated by the same reference signs, and the description thereof may be omitted.

In the first modification, the axial length of at least one rectifying blade portion 32 is longer than the axial length of the chassis 31. For example, as illustrated in FIG. 8, the axial length of the rectifying blade portion 32 may be longer than the axial length of the chassis 31. The one axial end portion of the rectifying blade portion 32 may be located on the one side Da1 in the axial direction with respect to the one axial end portion of the chassis 31. The other axial end portion of the rectifying blade portion 32 may be located on the other side Da2 in the axial direction with respect to the other axial end portion of the chassis 31. Incidentally, these relationships are applied to all the rectifying blade portions 32 in FIG. 8. However, the present disclosure is not limited to the example of FIG. 8, and the above-described relationship may be applied to some of the rectifying blade portions 32 and may not be applied to the remaining some of the rectifying blade portions 32. The axial end portion of the at least one rectifying blade portion 32 described above can be inserted into the first axial fan 1 and/or the second axial fan 2. Accordingly, the disturbance of the airflow F from the rectifying blade portion 32 to the first axial fan 1 and/or the disturbance of the airflow F from the second axial fan 2 to the rectifying blade portion 32 hardly occur. Therefore, it is possible to contribute to improvement of the PQ characteristic of the serial axial fan 100.

However, the present disclosure is not limited to the examples of the example embodiment (see FIG. 1) and the first modification (see FIG. 8) thereof, and the axial length of at least one rectifying blade portion 32 may be the same as the axial length of the chassis 31. Further, in the axial direction, the position of one axial end portion of the rectifying blade portion 32 may be the same as the position of one axial end portion of the chassis 31.

In the second modification, the serial axial fan 100 further includes an inner wall portion 41. For example, in FIG. 9, the first axial fan 1 has the inner wall portion 41. The inner wall portion 41 has a cylindrical shape extending in the axial direction. The inner wall portion 41 is attached to one axial end face of the first bracket portion 131. The inner wall portion 41 is accommodated in the chassis 31 and is disposed on the radially inner side with respect to the rectifying blade portion 32. The air feeding space 33 is provided on the radially outer side with respect to the inner wall portion 41. In the second modification, the air feeding space 33 annularly expands on the radially inner side with respect to the rectifying blade portion 32. Incidentally, in FIG. 9, the entire inner wall portion 41 is accommodated in the chassis 31. However, the present disclosure is not limited to this example, and a part of the inner wall portion 41 may be accommodated in the chassis 31. That is, in the axial direction, at least one of the one axial end portion and the other axial end portion of the inner wall portion 41 may protrude from the chassis 31. In this case, for example, the other axial end portion of the inner wall portion 41 may be accommodated in the first housing cylindrical portion 133 of the first axial fan 1. Further, the one axial end portion of the inner wall portion 41 may be accommodated in the second housing cylindrical portion 233 of the second axial fan 2. In this way, it is possible to suppress a part of the airflow F flowing from the first axial fan 1 toward the second axial fan 2 from flowing to the radially inner side in the chassis 31 of the rectifying portion 3. Therefore, the airflow F can flow toward the second axial fan 2 without a part thereof being stagnant in the vicinity of the central axis CA.

Preferably, the serial axial fan 100 further includes an inner blade portion 42. For example, in FIG. 9, the first axial fan 1 further includes the inner blade portion 42. The inner blade portion 42 extends to the radially outer side from the radially outer surface of the inner wall portion 41. The inner blade portion 42 is disposed on the radially inner side with respect to the rectifying blade portion 32. A plurality of inner blade portions 42 are arranged on the radially outer surface of the inner wall portion 41 in the circumferential direction. The inner blade portion 42 extends at least in the axial direction. Preferably, the inner blade portion 42 is inclined in the same direction as that of the rectifying blade portion 32 when viewed from the radial direction. For example, the inner blade portion 42 is inclined to the other side Dc2 in the circumferential direction from the other side Da2 in the axial direction toward the one side Da1 in the axial direction. Further, the air feeding space 33 is provided between the inner blade portion 42 and the rectifying blade portion 32 in the radial direction. In this way, the airflow F can smoothly flow from the first axial fan 1 toward the second axial fan 2. Incidentally, the present disclosure is not limited to the example of FIG. 9, and the inner blade portion 42 may be omitted.

Incidentally, in the second modification described above, the inner wall portion 41 and the inner blade portion 42 are a part of the first axial fan 1. However, the present disclosure is not limited to this example, and the inner wall portion 41 and the inner blade portion 42 may be a part of the second axial fan 2. For example, the inner wall portion 41 may be connected to the second housing cylindrical portion 233 via a support portion (not illustrated). Alternatively, the inner wall portion 41 and the inner blade portion 42 may be a part of the rectifying portion 3. For example, the inner wall portion 41 may be connected to the chassis 31 via a support portion (not illustrated).

The example embodiment of the present disclosure has been described above. Note that, the scope of the present disclosure is not limited to the above-described example embodiment. The present disclosure can be implemented by making various modifications to the above-described example embodiment without departing from the gist of the disclosure. In addition, the matters described in the above-described example embodiment can be discretionarily combined together as appropriate within a range where no inconsistency occurs.

The present disclosure is useful in a device in which two axial fans are connected in series.

Features of the above-described preferred example embodiments and the modifications thereof may be combined appropriately as long as no conflict arises.

While example embodiments of the present disclosure have been described above, it is to be understood that variations and modifications will be apparent to those skilled in the art without departing from the scope and spirit of the present disclosure. The scope of the present disclosure, therefore, is to be determined solely by the following claims.

What is claimed is:

1. A serial axial fan comprising:

a first axial fan including a first impeller;

a second axial fan including a second impeller; and a rectifying portion; wherein the first impeller includes a first rotor blade which is rotatable to one side in a circumferential direction about a central axis extending in an axial direction;

the second impeller includes a second rotor blade which is rotatable about the central axis;

the second axial fan is on one side in the axial direction with respect to the first axial fan and is connected in series to the first axial fan with the rectifying portion interposed therebetween;

the rectifying portion includes:

a chassis with a cylindrical shape surrounding the central axis;

a rectifying blade portion extending to a radially inner side from a radially inner surface of the chassis; and an air feeding space on the radially inner side of the rectifying blade portion;

the rectifying blade portion extends at least in the axial direction and is inclined relative to another side in the circumferential direction from another side in the axial direction toward the one side in the axial direction;

the air feeding space is an integral space through which an airflow is flowable on the radially inner side of the rectifying blade portion;

the air feeding space includes an empty clearance which: (i) extends radially all the way from a radially inner surface of the radially inner side of the rectifying blade portion to the central axis and (ii) extends all the way around the central axis in the circumferential direction at a position directly radially inward from the rectifying blade portion; and a radially innermost end portion of the rectifying blade portion is located radially between a radially outermost portion of the second rotor blade and an axially outermost portion of the second rotor blade.

2. The serial axial fan according to claim 1, wherein the first axial fan further includes a stator blade on the one side in the axial direction with respect to the first rotor blade and on the another side in the axial direction with respect to the rectifying blade portion; and the stator blade extends at least in the axial direction and is inclined to the another side in the circumferential direction from the another side in the axial direction toward the one side in the axial direction.

3. The serial axial fan according to claim 2, wherein a total number of the rectifying blade portions is equal to or larger than a total number of the stator blades.

4. The serial axial fan according to claim 3, wherein the rectifying blade portion includes a first curved portion at one axial end portion of the rectifying blade portion; and the first curved portion includes a curved surface protruding toward the one side in the axial direction and the other side in the circumferential direction in cross-sectional view as viewed from a radial direction.

5. The serial axial fan according to claim 4, wherein the rectifying blade portion includes a second curved portion at another axial end portion of the rectifying blade portion; and the second curved portion includes a curved surface protruding toward the other side in the axial direction in cross-sectional view as viewed from the radial direction.

6. The serial axial fan according to claim 5, wherein a circumferential width of the rectifying blade portion decreases from a radially outer side toward the radially inner side.

7. The serial axial fan according to claim 6, wherein the total number of the rectifying blade portions is coprime to a total number of blade portions in at least one of the first rotor blades and the second rotor blades.

8. The serial axial fan according to claim 7, wherein the rectifying blade portions are arranged at equal intervals in the circumferential direction.

9. The serial axial fan according to claim 7, wherein at least some of the plurality of rectifying blade portions arranged in the circumferential direction are arranged at intervals different from intervals of other portions.

10. The serial axial fan according to claim 1, wherein the axially outermost portion of the second rotor blade is a portion of the second rotor blade closest to the another side in the axial direction.

11. The serial axial fan according to claim 1, wherein the rectifying portion is a different element from at least one of the first axial fan and the second axial fan.

12. The serial axial fan according to claim 1, wherein an axial length of at least one of the rectifying blade portions is longer than an axial length of the chassis.

13. The serial axial fan according to claim 1, wherein the first axial fan further includes an inner wall portion with a cylindrical shape and extending in the axial direction, the inner wall portion is accommodated in the chassis and is on the radially inner side with respect to the rectifying blade portion; and the air feeding space is on the radially outer side with respect to the inner wall portion.

14. The serial axial fan according to claim 13, wherein the first axial fan further includes an inner blade portion extending to the radially outer side from a radially outer surface of the inner wall portion; and the inner blade portion is on the radially inner side with respect to the rectifying blade portion.

15. The serial axial fan according to claim 1, wherein the second impeller rotates to one side in the circumferential direction.

* * * * *